US007168928B1

(12) United States Patent
West et al.

(10) Patent No.: US 7,168,928 B1
(45) Date of Patent: Jan. 30, 2007

(54) AIR DRIVEN HYDRAULIC PUMP

(75) Inventors: Todd M. West, Hesperia, CA (US); Dennis E. Kennedy, Hemet, CA (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 286 days.

(21) Appl. No.: 10/781,926

(22) Filed: Feb. 17, 2004

(51) Int. Cl.
*F04B 43/06* (2006.01)
*F04B 45/00* (2006.01)

(52) U.S. Cl. ..... 417/395; 417/385

(58) Field of Classification Search ..... 417/384, 417/385, 395
See application file for complete search history.

(56) References Cited

U.S. PATENT DOCUMENTS

| | | | | | |
|---|---|---|---|---|---|
| 3,838,946 | A * | 10/1974 | Schall | 417/395 |
| 4,247,264 | A | 1/1981 | Wilden | 417/393 |
| 4,386,888 | A * | 6/1983 | Verley | 417/393 |
| 4,549,467 | A | 10/1985 | Wilden | 91/307 |
| 5,062,770 | A * | 11/1991 | Story et al. | 417/46 |
| 5,169,296 | A | 12/1992 | Wilden | 417/395 |
| 5,213,485 | A | 5/1993 | Wilden | 417/393 |
| 5,558,506 | A * | 9/1996 | Simmons et al. | 417/393 |
| 5,893,707 | A * | 4/1999 | Simmons et al. | 417/393 |
| 5,927,954 | A | 7/1999 | Kennedy et al. | 417/397 |
| 5,957,670 | A | 9/1999 | Duncan et al. | 417/395 |
| RE38,239 | E | 8/2003 | Duncan | 417/393 |
| 6,644,941 | B1 * | 11/2003 | Hancock et al. | 417/393 |
| 6,814,553 | B2 * | 11/2004 | Watanabe et al. | 417/473 |
| 6,874,997 | B2 * | 4/2005 | Watanabe et al. | 417/395 |

OTHER PUBLICATIONS

Haskel International, Inc., Liquid Pump Catalog, LP-GL (undated).

* cited by examiner

*Primary Examiner*—William H Rodriguez
(74) *Attorney, Agent, or Firm*—Connolly Bove Lodge & Hutz LLP

(57) ABSTRACT

An air driven hydraulic pump includes two opposed cylinders to either side of a center section. Two pneumatic pistons are slidable in the opposed cylinders and are coupled with one another by a common shaft extending through the center section. The pneumatic pistons ride in the opposed pneumatic cylinders and include hydraulic plungers extending therefrom. Cylinder heads integral with the cylinders provide hydraulic cylinders aligned with the hydraulic plungers. An air valve delivers pneumatic pressure to alternate sides of both pneumatic pistons such that the forces on the pistons are additive alternately in each direction.

7 Claims, 6 Drawing Sheets

AIR DRIVEN HYDRAULIC PUMP

BACKGROUND OF THE INVENTION

The field of the present invention is hydraulic pumps which are air driven.

Reciprocating air driven pumps are well known. Reference is made to U.S. Pat. Nos. 5,213,485; 5,169,296; and 4,247,264. Actuator valves using feed-back control systems are disclosed in U.S. Pat. Nos. 4,549,467 and 5,957,670. Another mechanism to drive an actuator valve is by solenoid such as disclosed in U.S. Pat. No. RE 38,239

Pumps using the above technology have been devised to increase pumping pressure. Reference is made to U.S. Pat. No. 5,927,954 which includes a power amplifier piston centered between two diaphragms.

The foregoing patents are double diaphragm pumps. Opposed piston pumps driven by an air cylinder are also known. Reference is made to U.S. Pat. No. 5,415,531. In addition to the reciprocating air cylinder driving opposed pistons, the pumping cylinders are shown to be smaller in diameter than the air cylinder in this patent. Consequently, the ratio of pressure applied to the pumped liquid relative to the air pressure driving the pump can be greater than one.

These pumps are advantageous where shop air or other convenient source of pressurized air is available for pumping. Often such a source of drive is desirable because such systems avoid components which can create sparks. Pneumatic pumps can also provide a constant source of pressure by simply being allowed to come to a stall point with the pressure left on. A pneumatic drive source capable of supply on demand is possible with such systems.

The combination of pneumatic drive with hydraulic output takes advantage of the foregoing and provides pressurized hydraulic supply. However, air driven hydraulic pumps are ancillary systems to hydraulic equipment, replacing a compact, frequently motor driven hydraulic pump. Consequently, economy of size and high power are desirable with such devices.

The disclosures of the U.S. Pat. Nos. 5,213,485; 5,169,296; 4,247,264; 4,549,467; 5,957,670; 5,927,954; RE 38,239; and 5,415,531 are incorporated herein by reference as if set forth in their entirety herein.

SUMMARY OF THE INVENTION

The present invention is directed to an air driven hydraulic pump including opposed cylinders, pistons slidable in the cylinders, a shaft assembly extending between the pistons and a valve assembly to provide alternating pressure to the pistons. Hydraulic cylinders extend from the opposed pneumatic cylinders with hydraulic plungers fixed to the pneumatic pistons.

In a first separate aspect of the present invention, the valve assembly is in selective fluid communication with both sides of each of the two pneumatic pistons. Further, the valve assembly is arranged to direct air pressure to the faces of the two pistons facing in a first direction at the same time and alternately to the faces of the two pistons facing in the opposite direction at the same time. As such, pneumatic force on the assembly is twice that imposed by the same pressure applied to a single piston. Further, the strokes in each direction are pressurizing strokes to alternate hydraulic cylinders.

In a second separate aspect of the present invention, the structure of the pump includes opposed pneumatic cylinders to either side of a center section. The cylinders are enclosed by heads having hydraulic cylinders therein. In addition, the cylinders and cylinder heads may be integrally formed and fastened to the center section.

In a further separate aspect of the present invention, any of the foregoing aspects may be combined to added advantage.

Accordingly, it is an object of the present invention to provide an improved air driven hydraulic pump. Other and further objects and advantages will appear hereinafter.

DETAILED DESCRIPTION OF THE PREFERRED EMBODIMENT

Figure 1:
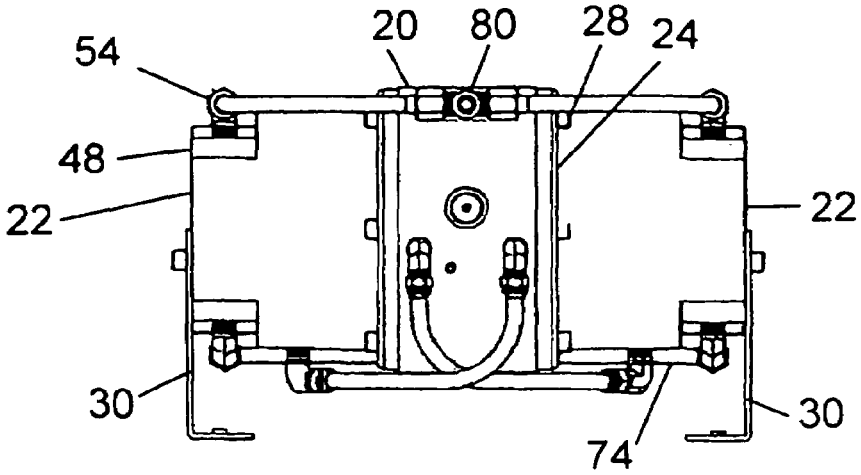
FIG. 1 is a front view of an air driven hydraulic pump.
Figure 2:
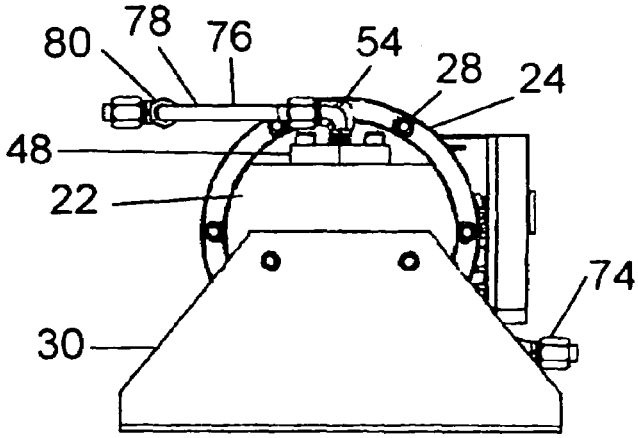
FIG. 2 is a side view of the air driven hydraulic pump.
Figure 3:
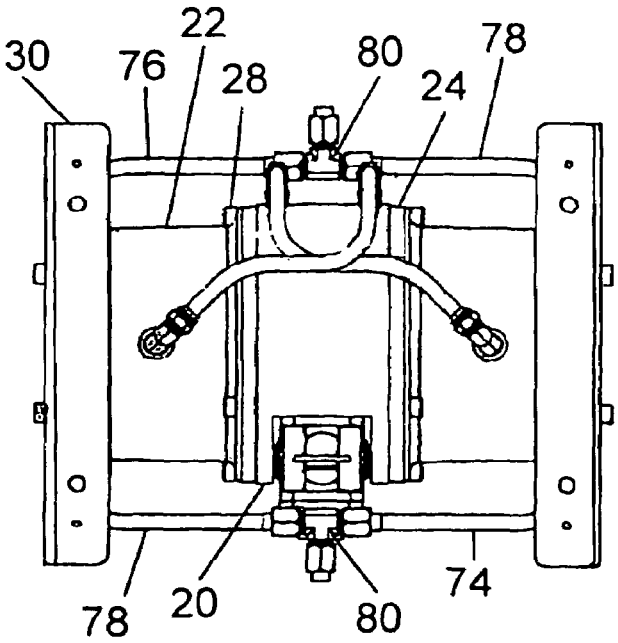
FIG. 3 is a bottom view of the air driven hydraulic pump.
Figure 4:
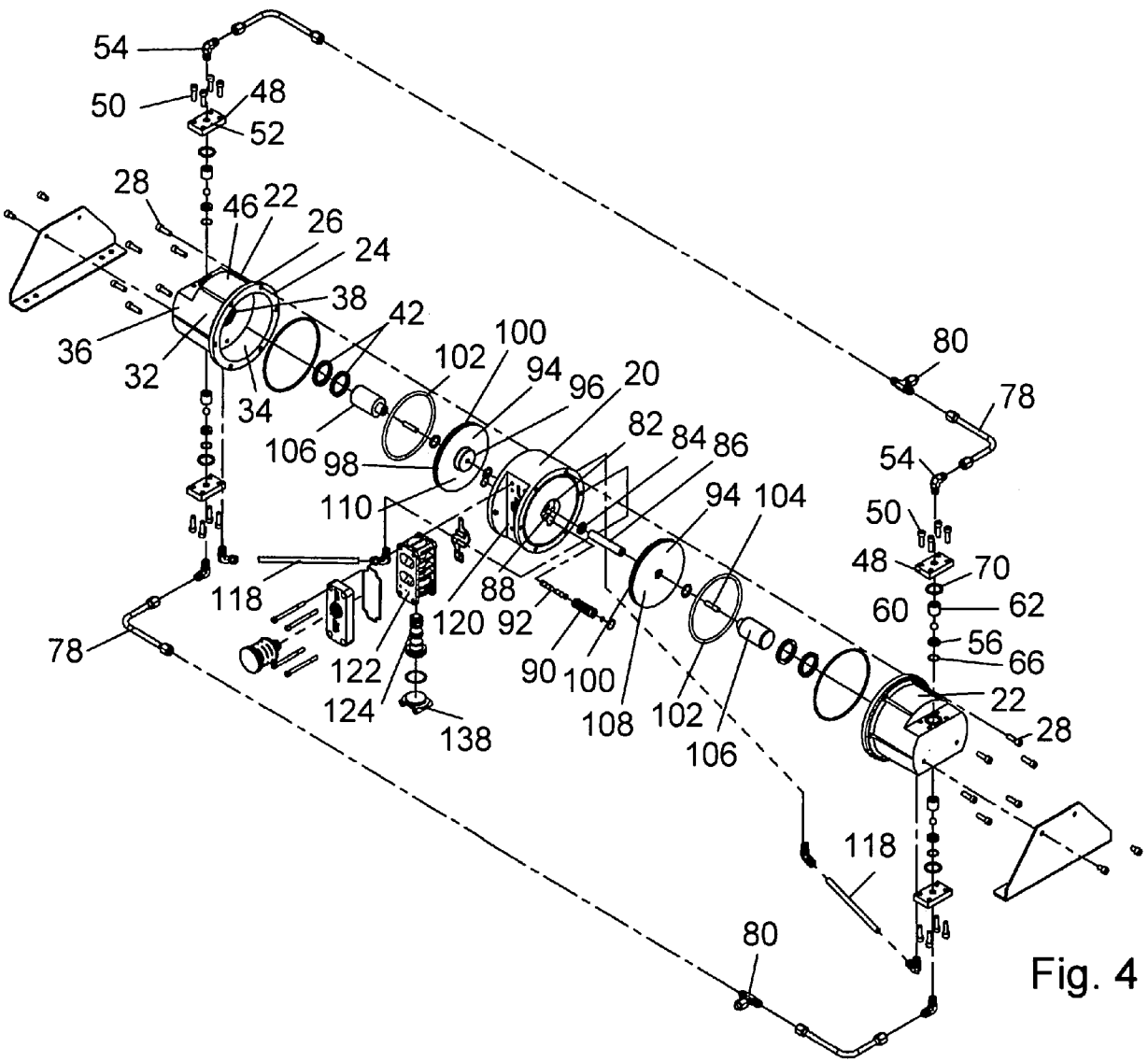
FIG. 4 is an exploded assembly perspective view of the air driven hydraulic pump.
Figure 5:
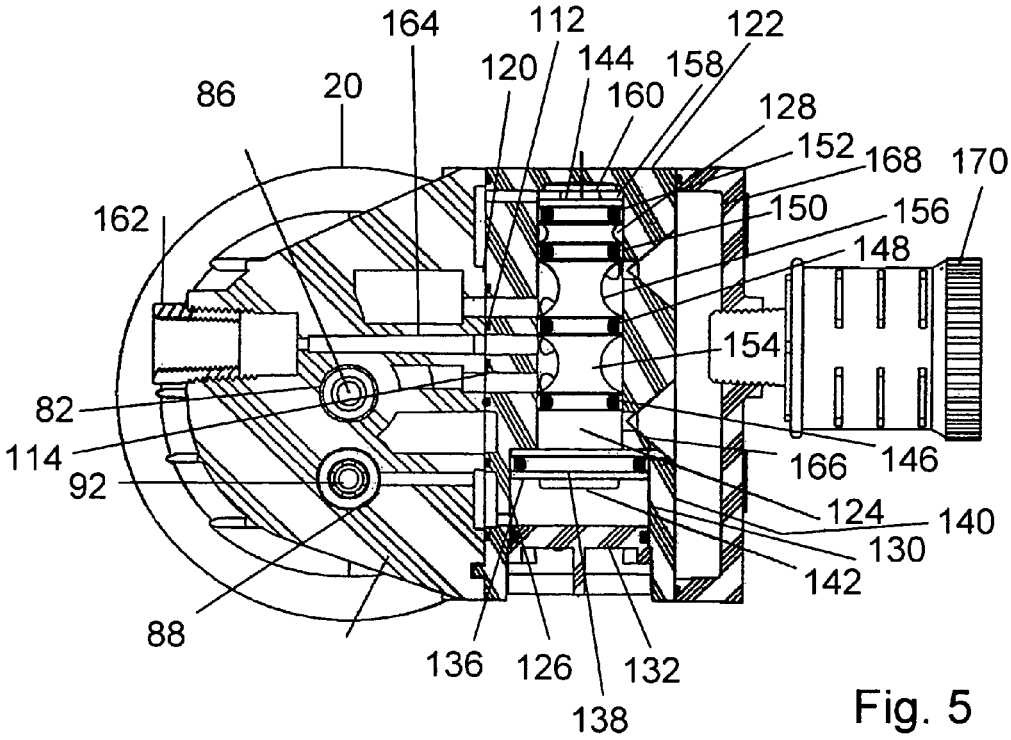
FIG. 5 is a cross-sectional view of the center section and valve of the air driven hydraulic pump.
Figure 6:
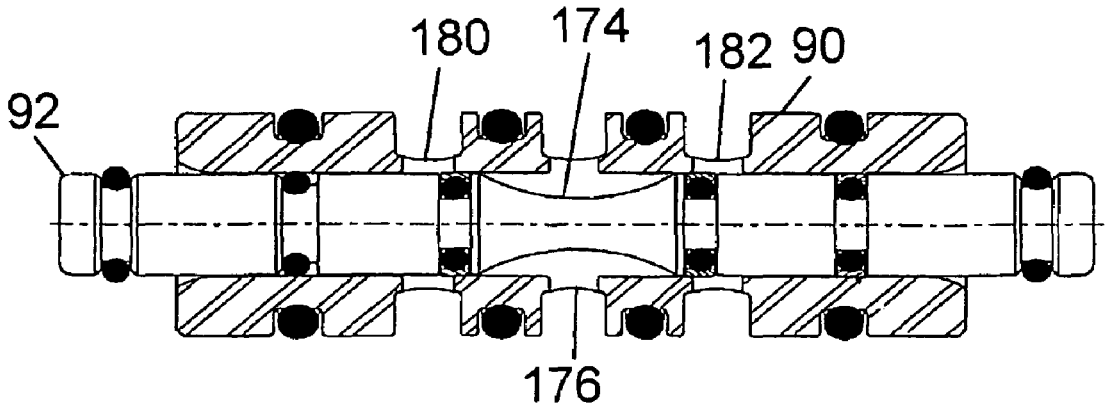
FIG. 6 is a side view of a pilot rod set within a pilot sleeve shown in cross section for clarity.
Figure 7:
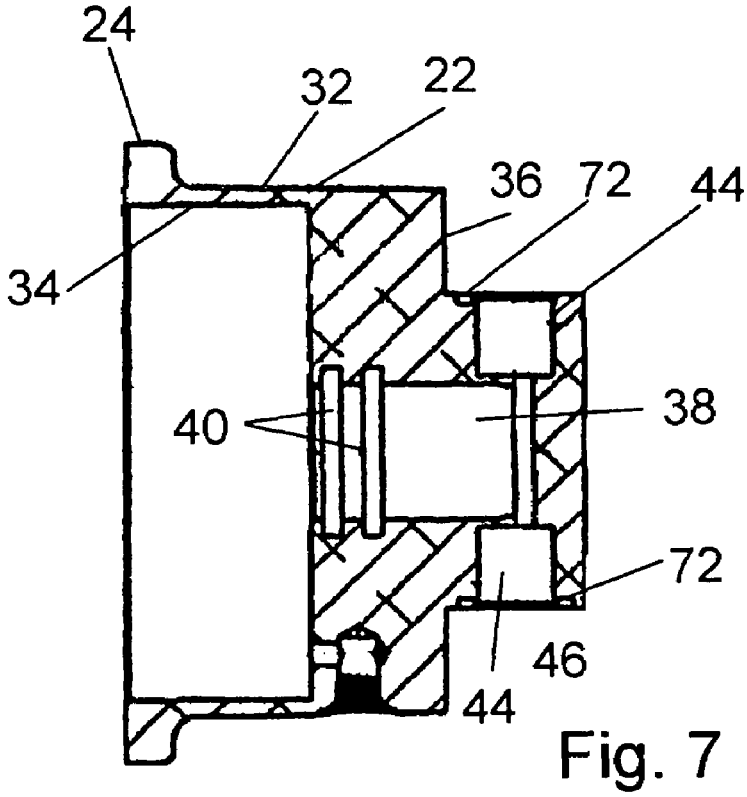
FIG. 7 is a cross-sectional view of a cylinder and cylinder head of the air driven hydraulic pump.

Turning in detail to the figures, an air driven hydraulic pump is illustrated. The pump structure includes a structural center section 20 with opposed integral cylinder/cylinder head units 22. Each cylinder/cylinder head unit 22 includes a circular mounting flange 24 with mounting holes 26 extending through the flange 24. The center section 20 includes tapped holes for receipt of bolts 28 positioned in the mounting holes 26 to securely affix the units 22 to the center section 20. Sheet metal feet 30 fastened to the ends of the units 22 extend at either end of the pump to define a mounting plane.

The cylinder/cylinder head units 22 are conveniently identical. Each unit 22 includes a cylinder 32 having a bore 34 concentrically therethrough to provide a pneumatic cylinder. The mounting flange 24 is at one end of the cylinder 32. At the other end, a cylinder head 36 closes the cylinder 32. The head 36 is integrally formed with the cylinder 32 and includes a concentric bore 38 forming a hydraulic cylinder thereby extending from the cylinder side of the head 36 into the body of the head 36. The bore 38 of the hydraulic cylinder is substantially smaller than the bore 34 of the pneumatic cylinder and includes circular grooves 40 for receiving circular seals 42. These seals 42 are U-cup seals.

Valve cavities 44 are located top and bottom in the periphery of the cylinder head 36. These cavities 44 open to the concentric bore 38 at the internal end thereof. Mounting flats 46 are provided in the bore about each cavity 44. These cavities are closed by plates 48 fastened in place by bolts 50 threaded into tapped holes through the flats 46. The plates 48 have tapped holes 52 for receipt of fittings 54 for communication of hydraulics to and from the concentric bore 38. Check valves are arranged in the cavities 44 and include a circular valve seat 56 with a passage 58 extending therethrough, a valve ball 60 sized to seal with the seat 56 and a ball cage 62 which allows the ball 60 to lift from the seat 56. Passages 64 allow flow about the ball and from the cage 62.

The inlet valve is in the bottom cavity 44 while the outlet valve is in the top cavity 44. Both valves are arranged with the valve seats 56 below the balls 60 and ball cages 62. An O-ring 66 is positioned in a circumferential groove 68 in each valve seat 56. Another O-ring 70 is positioned in a circular groove 72 cut into each flat 46. These O-rings 66 and 70 prevent leakage around the valve and from the housing, respectively.

An intake manifold 74 is coupled with each of the lower fittings 54 while an outlet manifold 76 is coupled to each of the upper fittings 54. Each manifold includes tubing 78 and a common T-fitting 80 to provide a single inlet to and a single outlet from the pump.

The center section 20 includes circular mounting surfaces to receive the cylinder/cylinder head units 22 as described above. A bore 82 extends through the center section 20 with O-ring grooves adjacent each end to receive sealing O-rings 84. A shaft 86 slideably extends through the concentric bore 82. The center section also includes a pilot passage 88 extending through the center section 20 parallel to the bore 82. This pilot passage 88 includes a pilot sleeve 90 fixed in the pilot passage 88 and a pilot rod 92 sideably extending through the pilot sleeve 90. The pilot rod 92 reciprocates back and forth in the center section 20 as does the shaft 86. Access cavities 93 are countersunk into the body of the center section 20 about the pilot passage 88 and the bore 82.

Two pneumatic pistons 94 are positioned to either side of the center section 20 and are associated with the shaft 86. These pistons 94 are illustrated to have a hub 96 surrounded by a disk 98 with an O-ring groove 100 concentrically arranged about the outer periphery of the disk 98. An O-ring 102 is positioned in the O-ring groove 100. Each hub 96 abuts against an end of the shaft 86.

Attachment pins 104 are threaded into the ends of the shaft 86 and extend through the hubs 96 of the pneumatic pistons 94. Hydraulic plungers 106 fit into recesses in the hubs 96 and engage the attachment pins 104 which form part of a shaft assembly with the shaft 86. Thus, the shaft assembly retains the pneumatic pistons 94 and the hydraulic plungers 106 fixed together. The pneumatic pistons 94 are slidable within the pneumatic cylinder bores 34 and the hydraulic plungers 106 are slidable within the concentric bores 38 defining the hydraulic cylinders. Seals identified above prevent loss of fluid around each plunger.

The pneumatic pistons have pressure receiving faces to either side of each disk 98. These faces are identified for convenience as the outward faces 108 and the attachment faces 110. Both faces are in selective communication with a valve assembly directing pressurized air through the center section 20. Air chamber passages 112 and 114 extend from the valve to either face of the center section 20 to communicate with the pneumatic cylinders 32 on the attachment face sides 110 of the pneumatic pistons 94. Passages 116 extend from the faces of the center section 20 through lines 118 to the faces of the cylinder heads 36 in communication with the outward faces 108 of the pneumatic pistons 94. Each passage 116 communicates the inner end of one pneumatic cylinder 32 with the outer end of the other pneumatic cylinder 32.

A valve assembly is associated with the center section 20. A mounting flat 120 accommodates this assembly. The valve assembly receives compressed air from a source of pressurized air, distributes that air alternately to opposite surfaces of each of the pistons and releases the air when spent. The valve includes a valve body 122 with a valve spool 124 operatively positioned to move therein. The valve spool 124 moves in a cylinder 126. The cylinder 126 includes a small end 128 and a large end 130. An end cap 132 closes the large end 130.

The valve spool 124 includes a piston 136 which is positioned within the large end 130 of the cylinder 126. The piston 136 includes an annular sealing groove 138 to receive a seal 140. A small raised portion 142 insures an annular space between the end of the piston 136 and the end cap 132 with the valve spool 124 positioned toward the large end 134.

The valve spool 124 additionally includes a body 144 which is smaller in diameter than the large piston 136 and extends through the small end 128 of the cylinder 126. The piston body 144 includes four seals 146, 148, 150 and 152. Between the seals 146 and 148, the body 144 is reduced in diameter to provide an axial passage 154 for the flow of air. The body 144 includes another axial passage 156 where the diameter is also reduced between the seals 148 and 150. A small piston surface 158 is at the small end 128 of the cylinder 126. The seal 152 prevents bypass flow from the small end 128 of the cylinder 126. Again, a small raised portion 160 insures an annular space at the small end with the valve spool 124 positioned toward the small end of the cylinder 126.

A source of pressurized air includes a fitting 162 communicating with the cylinder 126 through a passage 164. Depending on the location of the valve spool 124, this passage 164 is either in communication with the axial passage 154 or the axial passage 156. In turn, air is distributed from the passages 154 and 156 to the air chamber passages 112 and 114, respectively, for distribution to either side of the center section 20. The valve body 122 also includes exhaust ports 166 which exhaust into a chamber 168 and then through a muffler 170. The axial passages 154 and 156 communicate between the air chamber passages 112 and 114 and the exhaust ports 166 when the same axial passages 154 and 156 are not communicating between the air chamber passages 112 and 114 and the inlet passage 164.

Figure 8:
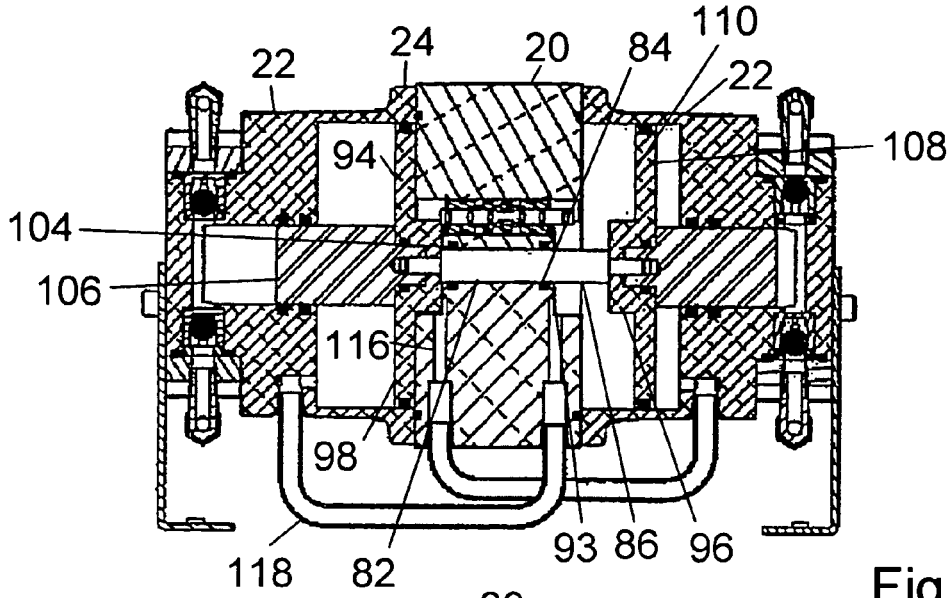
FIG. 8 is a cross-sectional assembly view of the air driven hydraulic pump with the piston assembly at a first end of its stroke.
Figure 9:
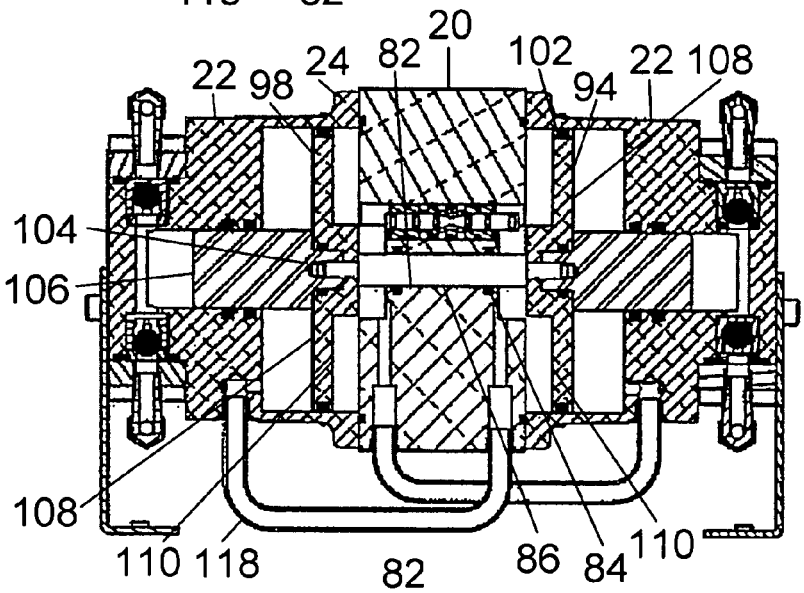
FIG. 9 is a cross-sectional assembly view of the air driven hydraulic pump with the piston assembly at mid stroke.
Figure 10:
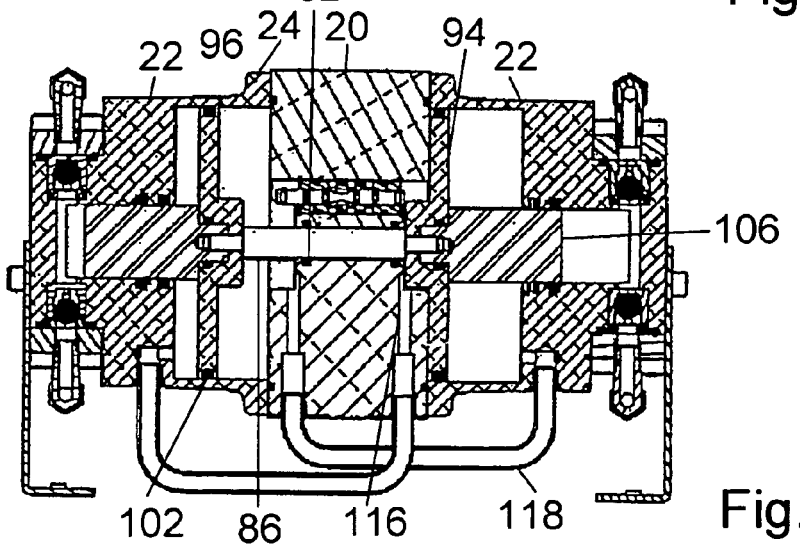
FIG. 10 is a cross-sectional assembly view of the air driven hydraulic pump with the piston assembly at the other end of its stroke.
Figure 13:
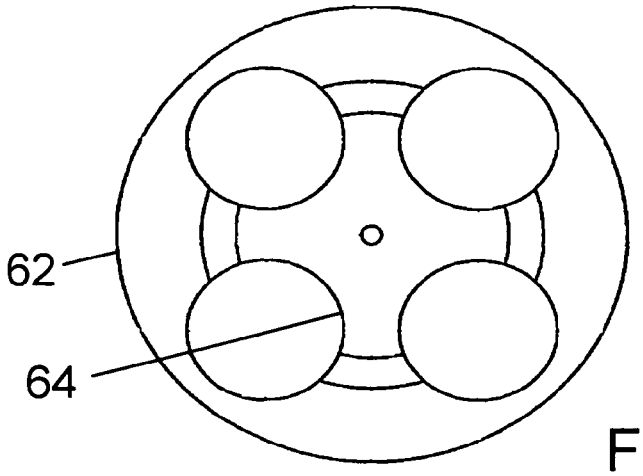
FIG. 13 is a top view of a ball cage for the hydraulic cylinder valve.
Figure 14:
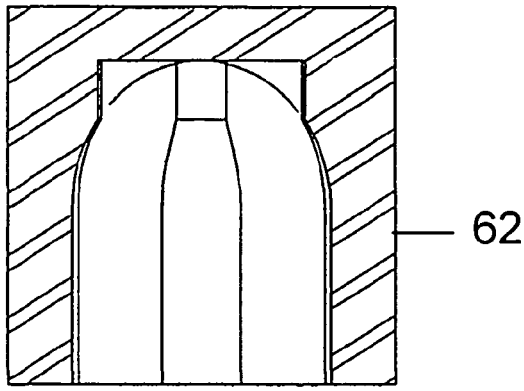
FIG. 14 is a cross-sectional side view of the ball cage of FIG. 13.
Figure 12:
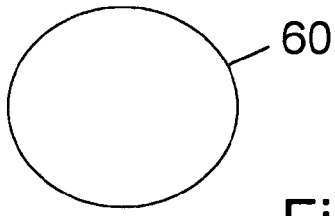
FIG. 12 is a view of a valve ball.
Figure 11:
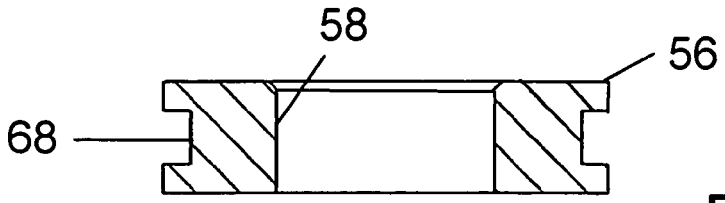
FIG. 11 is a cross-sectional view of a ball seat for a hydraulic cylinder valve.

To effect shifting of this valve to create the appropriate alternate flow, the small end of the cylinder 126 is always pressurized to act against the small piston surface 158. The piston 136 at the large end 130 of the cylinder 126 is pressurized or depressurized responsive to the position of the pilot rod 92. The pilot rod 92 has a single axial passage 174 defined on the surface thereof. The port 176 through the pilot sleeve 90 includes passage to the large end 130 of the cylinder 126. A pressure port 180 extends through the sleeve 90 to one side of the port 176 while a vent port 182 extends through the sleeve 90 to the other side of the port 176. Through movement of the pilot rod 92, the large end 130 of the cylinder 126 is either vented or pressurized across the axial passage 174. When the large end 130 is pressurized, the piston 136 experiences a force greater than the force on the small piston surface 158 which has a smaller surface area. When the piston 136 is not pressurized, the small piston surface 158 becomes dominant and the force is reversed. In this way, the valve spool 124 exhibits a controlled oscillation responsive to the position of the pilot rod 92. As can be seen in FIGS. 8, 9 and 10, the movement of the hubs 96 of the pneumatic pistons 94 drive the pilot rod 92 back and forth across the center section 20. Consequently, the large end 130 of the cylinder 126 is alternately pressurized and depressurized responsive to the position of the hubs 96 such that the air flow is reversed through the valve assembly.

In operation, pressurized air is supplied to the valve assembly to induce pumping action. The valve assembly is necessarily positioned at one end or the other of the cylinder 126 to dictate the direction of air flow in the direction of movement of the shaft assembly and pistons. The flow into one of the cylinders 32 acts against the attachment face 110 of one of the pistons 94. Further, flow through the passage 116 through that cylinder receiving the supply directs pneumatic pressure to the outward face 108 of the opposite pneumatic piston 94. Thus, one side of each of two pistons is pressurized so as to double the force acting in one direction.

Upon shifting of the valve assembly, the opposite two surfaces are pressurized to move the assembly in the opposite direction. The attached hydraulic plungers 106 necessarily move with the pneumatic pistons 94. As the cross-sectional working area is much smaller for the hydraulic plungers 106, the pressure exerted by each hydraulic plunger 106 is greater than the pneumatic pressure by two times the ratio of the cross-sectional area of the pneumatic cylinder 32 to the cross-sectional area of the hydraulic cylinder 38.

The arrangement of the cylinder/cylinder head units 22 facilitates fabrication as the pneumatic cylinder bore and the hydraulic cylinder bore are both in the same part. Further, removal of a unit 22 provides access to all piston and cylinder seals for service.

Thus, an improved air driven hydraulic pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven hydraulic pump comprising two opposed pneumatic cylinders;

two pneumatic pistons slideable in the opposed pneumatic cylinders, respectively, each pneumatic piston including an outward face and an attachment face;

a shaft assembly extending between the two opposed pneumatic pistons and coupled with the attachment face of each piston;

a valve assembly in selective fluid communication with both the attachment face and the outward face of each pneumatic piston in the opposed pneumatic cylinders and in communication with a source of pressurized air, the valve assembly being constructed and arranged to direct air pressure to the attachment face of one of the two pneumatic pistons and the outward face of the other of the two pneumatic pistons at the same time and alternately to the outward face of the one of the two pneumatic pistons and the attachment face of the other of the two pneumatic pistons at the same time;

hydraulic cylinders extending from the opposed pneumatic cylinders, respectively;

hydraulic plungers slideable in the hydraulic cylinders, respectively, the hydraulic plungers being fixed to the two pneumatic pistons, respectively.

2. The pump of claim 1, the valve assembly alternately directing air pressure responsive to the location of the two pneumatic pistons and shaft assembly.

3. The pump of claim 1 further comprising a center section assembly between the two opposed pneumatic cylinders at the inner ends thereof, the valve assembly being attached to the center section assembly;

two cylinder heads closing outer ends of the two opposed pneumatic cylinders, respectively, the hydraulic cylinders being in the two cylinder heads.

4. The pump of claim 3, the two opposed pneumatic cylinders being integral with the two cylinder heads, respectively, each pneumatic cylinder being fastened to the center section.

5. The pump of claim 3 further comprising passages between the center section and the pneumatic cylinders, respectively, the passages being in fluid communication with the outward faces of the pneumatic pistons, respectively.

6. An air driven hydraulic pump comprising two opposed pneumatic cylinders;

two pneumatic pistons slideable in the opposed pneumatic cylinders, respectively, each pneumatic piston including an outward face and an attachment face;

a shaft assembly extending between the two opposed pneumatic pistons and coupled with the attachment face of each pneumatic piston;

a valve assembly in selective fluid communication with both the attachment face and the outward face of each pneumatic piston in the opposed pneumatic cylinders and in communication with a source of pressurized air, the valve assembly being constructed and arranged to direct air pressure to the attachment face of one of the two pneumatic pistons and the outward face of the other of the two pneumatic pistons at the same time and alternately to the outward face of the one of the two pneumatic pistons and the attachment face of the other of the two pneumatic pistons at the same time;

hydraulic cylinders extending from the opposed pneumatic cylinders, respectively;

hydraulic plungers slideable in the hydraulic cylinders, respectively, the hydraulic plungers being fixed to the two pneumatic pistons, respectively;

a center section assembly between the two opposed pneumatic cylinders at the inner ends thereof, the valve assembly being attached to the center section assembly;

two cylinder heads closing outer ends of the two opposed pneumatic cylinders, respectively, the hydraulic cylinders being in the two cylinder heads, the two opposed pneumatic cylinders being integral with the two cylinder heads, respectively, each pneumatic cylinder being fastened to the center section;

passages between the center section and the pneumatic cylinders, respectively, the passages being in fluid communication with the outward faces of the pneumatic pistons, respectively.

7. The pump of claim 6, the valve assembly alternately directing air pressure responsive to the location of the two pneumatic pistons and shaft assembly.

* * * * *